US009124984B2

(12) United States Patent
Yamada et al.

(10) Patent No.: US 9,124,984 B2
(45) Date of Patent: Sep. 1, 2015

(54) HEARING AID, SIGNAL PROCESSING METHOD, AND PROGRAM

(75) Inventors: Maki Yamada, Kanagawa (JP); Mitsuru Endo, Tokyo (JP); Koichiro Mizushima, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 751 days.

(21) Appl. No.: 13/388,494

(22) PCT Filed: Jun. 16, 2011

(86) PCT No.: PCT/JP2011/003426

§ 371 (c)(1),
(2), (4) Date: Feb. 2, 2012

(87) PCT Pub. No.: WO2011/158506

PCT Pub. Date: Dec. 22, 2011

(65) Prior Publication Data

US 2012/0128187 A1 May 24, 2012

(30) Foreign Application Priority Data

Jun. 18, 2010 (JP) ..... 2010-139726

(51) Int. Cl.
*H04R 25/00* (2006.01)

(52) U.S. Cl.
CPC ..... *H04R 25/407* (2013.01); *H04R 25/405* (2013.01); *H04R 25/552* (2013.01); *H04R 25/558* (2013.01); *H04R 2225/43* (2013.01)

(58) Field of Classification Search
CPC ..... H04R 2225/43; H04R 25/405; H04R 25/407; H04R 25/552; H04R 25/558
USPC ..... 381/92, 312, 313, 315, 316, 318
See application file for complete search history.

(56) References Cited

U.S. PATENT DOCUMENTS 6,072,884 A * 6/2000 Kates ..... 381/318
8,170,247 B2 * 5/2012 Nishizaki et al. ..... 381/312

(Continued)

FOREIGN PATENT DOCUMENTS

CN 1897765 A 1/2007
CN 101263737 A 9/2008

(Continued)

OTHER PUBLICATIONS

Supplementary European Search Report (ESR) issued Feb. 27, 2013 in European Patent Application No. EP 11 79 5414.

(Continued)

*Primary Examiner* — Davetta W Goins
*Assistant Examiner* — Phylesha Dabney
(74) *Attorney, Agent, or Firm* — Wenderoth, Lind & Ponack, L.L.P.

(57) ABSTRACT

A hearing aid, signal processing method and program enables TV sound to be made easier for a hearing aid user to hear when wishing to watch TV, and a person's voice to be made easier to hear when wishing to converse with that person. The hearing aid includes another-person's speech detection section that detects speech of a speaker other than the wearer using detected sound source direction information, an own-speech detection result, and a TV sound detection result, and a per-sound-source frequency calculation section that calculates the frequency of each sound source using an own-speech detection result, TV sound detection result, other-speaker's speech detection result, and sound source direction information. A scene determination section determines a scene using sound source direction information and a per-sound-source frequency; and an output sound control section controls hearing of the hearing aid according to a determined scene.

32 Claims, 14 Drawing Sheets

(56) References Cited

U.S. PATENT DOCUMENTS

| | | | | |
|---|---|---|---|---|
| 8,526,653 | B2 * | 9/2013 | Iwano et al. | 381/330 |
| 2002/0037087 | A1 | 3/2002 | Allegro et al. | |
| 2002/0090098 | A1 | 7/2002 | Allegro et al. | |
| 2004/0066945 | A1 | 4/2004 | Fischer et al. | |
| 2006/0177079 | A1 | 8/2006 | Jensen et al. | |
| 2007/0009122 | A1 | 1/2007 | Hamacher | |
| 2008/0192969 | A1 | 8/2008 | Welner | |
| 2009/0185704 | A1 | 7/2009 | Hockley | |
| 2010/0189293 | A1 | 7/2010 | Imamura et al. | |
| 2011/0091056 | A1 * | 4/2011 | Nishizaki et al. | 381/312 |

FOREIGN PATENT DOCUMENTS

| | | | |
|---|---|---|---|
| CN | 101433098 | A | 5/2009 |
| DE | 102 36 167 | | 2/2004 |
| EP | 1 348 315 | | 10/2003 |
| EP | 2 081 405 | | 7/2009 |
| JP | 58-088996 | A | 5/1983 |
| JP | 62-150464 | A | 7/1987 |
| JP | 64-55793 | U | 4/1989 |
| JP | 03-245699 | A | 11/1991 |
| JP | 06-086399 | A | 3/1994 |
| JP | 09-327097 | A | 12/1997 |
| JP | 2007-28610 | A | 2/2007 |
| JP | 2007-515830 | A | 6/2007 |
| JP | 2009-512372 | A | 3/2009 |
| JP | 2009-528802 | A | 8/2009 |
| WO | 01/20965 | | 3/2001 |
| WO | 2007/098768 | A1 | 9/2007 |
| WO | 2009/001559 | A1 | 12/2008 |

OTHER PUBLICATIONS

International Search Report for PCT/JP2011/003426 dated Jul. 12, 2011.

* cited by examiner

| SCENE | OWN SPEECH | OTHER-PERSON'S SPEECH | | TV | |
|---|---|---|---|---|---|
| | FREQUENCY FS (AMOUNT OF SPEECH) | DIRECTION DP | FREQUENCY FS (AMOUNT OF SPEECH) | DIRECTION DT | FREQUENCY FT (TV-ONLY INTERVAL AMOUNT) |
| CONVERSATION | HIGH | FRONTAL | NORMAL | NOT FRONTAL | LOW |
| TV | LOW | NOT FRONTAL | HIGH | FRONTAL | LOW |
| VIEWING WHILE | HIGH | NOT FRONTAL | NORMAL | FRONTAL | HIGH |

FIG.11

| SCORE | OWN SPEECH | | OTHER-PERSON'S SPEECH | | | TV | | |
|---|---|---|---|---|---|---|---|---|
| | $Fs \geqq \theta$ | $Fs < \theta$ | $\lvert Dp \rvert \leqq 22.5$ | $\lvert Dp \rvert > 22.5$ | $Fp \geqq \theta$ | $\lvert Dt \rvert \leqq 22.5$ | $Ft \geqq \theta$ | $\lvert Dt \rvert > 22.5$ |
| CONVERSATION SCENE SCORE | +10 | | +5 | | | | | +5 |
| TV SCENE SCORE | | +10 | | +5 | +5 | +5 | | |
| 'VIEWING WHILE ...' SCENE SCORE | +10 | | | +5 | | +5 | +5 | |

FIG.12

HEARING AID, SIGNAL PROCESSING METHOD, AND PROGRAM

TECHNICAL FIELD

The present invention relates to a hearing aid, signal processing method, and program that make a desired sound easier to hear for a hearing aid user.

BACKGROUND OF THE INVENTION

Background Art

Generally, when hearing ability declines, small sounds become difficult to hear. A hearing aid is a device that amplifies such small sounds, making them easier to hear for a person with reduced hearing ability. However, since a hearing aid increases not only a desired sound but also noise, it is difficult to hear the voice of a person who is conversing with, or the sound of a TV, in a noisy environment.

A method of making only a specific sound easier to hear in a noisy environment is to orient the directivity of a microphone toward a desired sound source. Orienting the directivity of a hearing aid microphone toward a desired sound source suppresses ambient noise and improves the SNR (Signal to Noise ratio), enabling only a specific sound in that direction to be made easier to hear.

In Patent Literature 1, a microphone is described that detects a sound source direction by having two or more pairs of directivities, and switches to the detected direction. By having its directivity oriented in the direction of a sound source, the microphone described in Patent Literature 1 can make sound from the sound source easier to hear when there is only one sound source, but when there are a plurality of sound sources it is necessary for the hearing aid user to specify in which direction the desired sound source is located.

In Patent Literature 2, a hearing aid is described that automatically controls directivity rather than having the user specify the direction of a desired sound source by means of an operation. The hearing aid described in Patent Literature 2 detects the hearing aid user's line of sight, and orients directivity in that line of sight direction.

On the other hand, another method of making only a specific sound easier to hear in a noisy environment is for the sound of a TV to be captured by a hearing aid directly, and output from the hearing aid speaker. With this method, the sound of a TV, audio device, or mobile phone is captured by a hearing aid using Bluetooth radio communication by means of a user operation, and the captured TV or other sound can be heard directly via the hearing aid. An example of a product that uses such a method is Tek Multi Navigator (SIEMENS) (http://www.siemens-hi.co.jp/catalogue/tek.php#). However, as in the case of Patent Literature 2, this method requires a hearing aid user to perform a manual switching operation when viewing TV and so forth.

CITATION LIST

Patent Literature

PTL 1
Japanese Utility Model Registration Application No. 62-150464
PTL 2
Japanese Patent Application Laid-Open No. 9-327097
PTL 3
Japanese Patent Application Laid-Open No. 58-88996

SUMMARY OF INVENTION

However, in a typical household there are a plurality of sound sources, and which sound a user wishes to hear varies from moment to moment. A TV, in particular, is a sound source that is routinely present in a household. Since a TV is often left switched on and emitting sound even when not being watched, there are many cases in which a plurality of sound sources—conversation and TV sound—are present.

In a case in which a plurality of sound sources—conversation and TV sound—are present in this way, it is desirable for the voice of a conversation partner to be made easier to hear when conversing with a family member, and for the sound of the TV to be made easier to hear when wishing to watch TV. However, with the above-described conventional technologies, it is necessary for a hearing aid user to perform a manual operation regarding which sound the user wishes to hear, and that is burdensome.

Also, with the apparatus described in Patent Literature 2, directivity is controlled automatically in a line of sight direction by means of line of sight detection. However, there is a problem if a hearing aid user wishes to discuss a TV program being watched with other family members, since directivity is oriented toward the TV, which is the line of sight direction, making it difficult to hear a family member's voice and hold a conversation.

It is an object of the present invention to provide a hearing aid, signal processing method, and program that enable TV sound to be made easier for a hearing aid user to hear when wishing to watch TV, and a person's voice to be made easier to hear when wishing to converse with that person.

Solution to Problem

A hearing aid of the present invention has a microphone array worn on both ears, and employs a configuration having: a sound source direction estimation section that detects a sound source direction from a sound signal input from the microphone array; an own-speech detection section that detects the voice of a hearing aid wearer from the sound signal; a TV sound detection section that detects TV sound from the sound signal; an other-speaker's speech detection section that detects speech of a speaker other than a wearer based on the detected sound source direction information, the own-speech detection result, and the TV sound detection result; a per-sound-source frequency calculation section that calculates the frequency of each sound source based on the own-speech detection result, the TV sound detection result, the other-speaker's speech detection result, and the sound source direction information; a scene determination section that determines a scene using the sound source direction information and the per-sound-source frequency; and an output sound control section that controls hearing of a hearing aid according to the determined scene.

A signal processing method of the present invention is a signal processing method of a hearing aid having a microphone array worn on both ears, and has: a step of detecting a sound source direction from a sound signal input from the microphone array; a step of detecting the voice of a hearing aid wearer from the sound signal; a step of detecting TV sound from the sound signal; a step of detecting speech of a speaker other than a wearer based on the detected sound source direction information, the own-speech detection result, and the TV sound detection result; a step of calculating the frequency of each sound source using the own-speech detection result, the TV sound detection result, the other-speaker's speech detection result, and the sound source direction information; a step of determining a scene based on the sound source direction information and the per-sound-source frequency; and a step of controlling hearing of a hearing aid according to the determined scene.

From another viewpoint, the present invention is a program that causes a computer to execute each step of the above-described signal processing method.

The present invention enables a hearing aid user to make a sound the user wishes to hear easier to hear according to a scene when there are a plurality of sound sources comprising a TV and conversation. For example, the sound of a TV becomes easier to hear when a hearing aid user wishes to watch TV, and a person's voice becomes easier to hear when a hearing aid user wishes to converse with that person, and furthermore, in a situation in which a hearing aid user holds a conversation while watching TV, not one or other of the sounds but both sounds can be heard.

BRIEF DESCRIPTION OF DRAWINGS

FIG. 11 is a drawing showing a table indicating scene features of a hearing aid according to the above embodiment;

FIG. 12 is a drawing representing an example of scene determination by means of a point addition method of a hearing aid according to the above embodiment;

DETAILED DESCRIPTION OF THE INVENTION

Now, an embodiment of the present invention will be described in detail with reference to the accompanying drawings.

Embodiment

Figure 1:
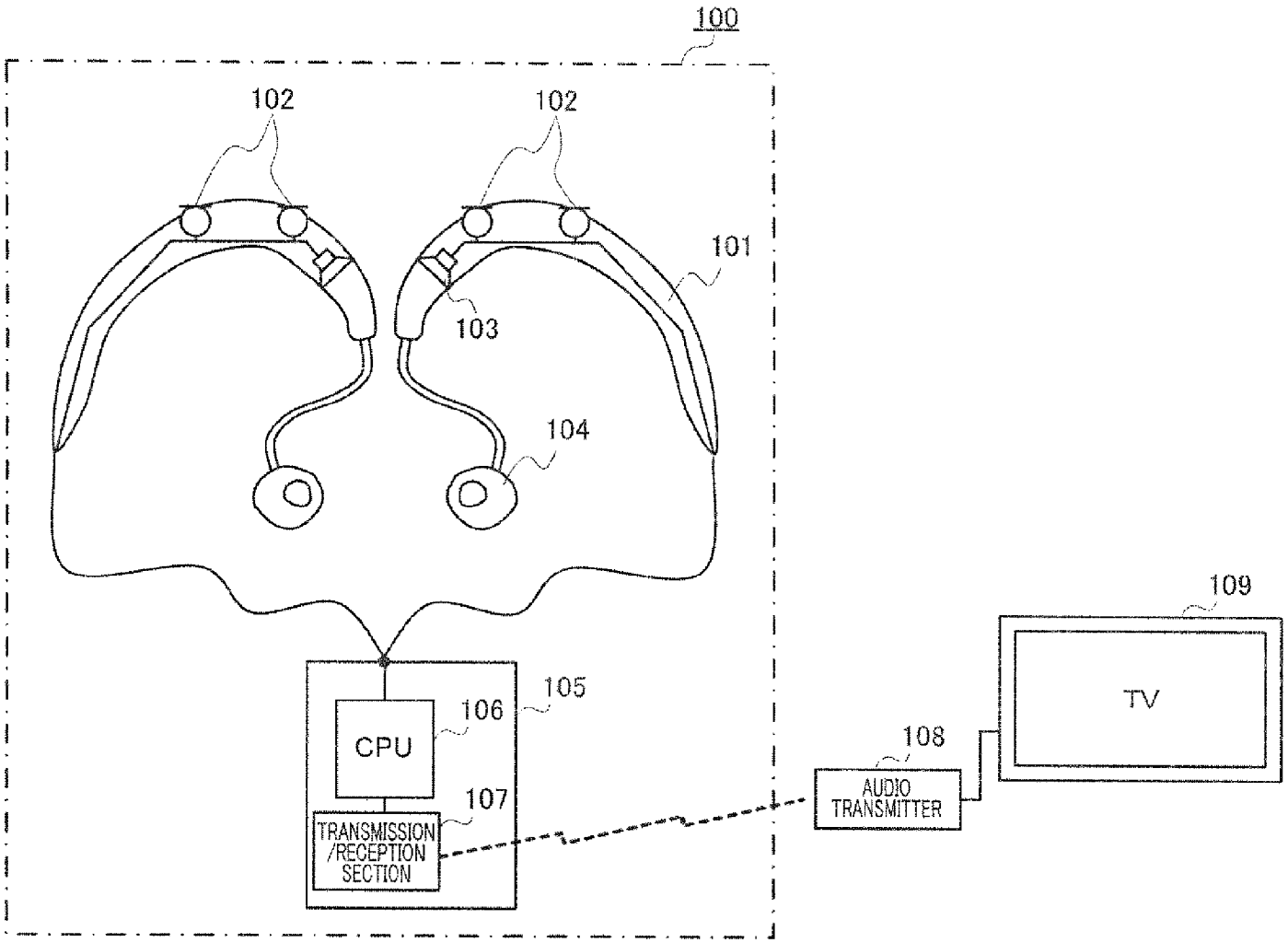
FIG. 1 is a drawing showing the configuration of a hearing aid according to an embodiment of the present invention.

FIG. 1 is a drawing showing the configuration of a hearing aid according to an embodiment of the present invention. This embodiment is an example of application to a remotely controlled hearing aid of a type in which the hearing aid body and earphones are separate (hereinafter abbreviated to "hearing aid").

As shown in FIG. 1, hearing aid 100 is provided with hearing aid housings 101 that fit around the ears, and remote control apparatus 105 connected to hearing aid housings 101 by wires.

There are two identically configured hearing aid housings 101, for the left and right ear respectively. Left and right hearing aid housings 101 each have microphone array 102 comprising two microphones that pick up ambient sound installed in a front-and-rear arrangement in the upper part, for a total of four microphones.

Each hearing aid housing 101 incorporates speaker 103 that outputs sound that has undergone hearing enhancement processing or TV sound, and speaker 103 is connected by means of a tube to ear tip 104 that fits inside the ear. A hearing aid user can hear sound output from speaker 103 from ear tip 104.

Remote control apparatus 105 is provided with CPU 106 that performs hearing aid 100 control and computational operations, and transmission/reception section 107 that receives a radio wave sent from audio transmitter 108.

Audio transmitter 108 is connected to TV 109, and transmits a TV sound signal by means of Bluetooth or suchlike radio communication.

On receiving a radio wave sent from audio transmitter 108, transmission/reception section 107 sends the received TV sound to CPU 106.

Also, sound picked up by microphone array 102 is sent to CPU 106 in remote control apparatus 105.

CPU 106 performs hearing enhancement processing such as directivity control or amplification of gain of a frequency band for which hearing ability has declined on sound input from microphone array 102 to enable the hearing aid user to hear the sound better, and outputs the sound from speaker 103. Also, CPU 106 outputs received TV sound from speaker 103 according to the circumstances. The CPU 106 signal processing method is illustrated in detail by means of FIG. 4 through FIG. 13.

Normally, remote control apparatus 105 is placed in a hearing aid user's breast pocket or the like, processes sound picked up by microphone array 102 inside hearing aid housing 101, and provides this sound to the user wearing ear tip 104.

Transmission/reception section 107 incorporated in remote control apparatus 105 of hearing aid 100 receives a radio signal transmitted from audio transmitter 108 connected to TV 109. The hearing aid user can switch between hearing actual ambient sound acquired by hearing aid 100 and TV 109 sound. Hearing aid 100 not only enables switching by means of a hearing aid user operation, but also automatically determines the situation and enables the hearing aid user to hear desired sound in an optimal fashion.

In this embodiment, hearing aid housings 101 are connected to remote control apparatus 105 by wires, but radio connection may also be used. Also, left and right hearing aid housings 101 may be provided with a DSP (Digital Signal Processor) that performs some of the signal processing, rather than having all hearing enhancement processing performed by CPU 106 in remote control apparatus 105.

Figure 2:
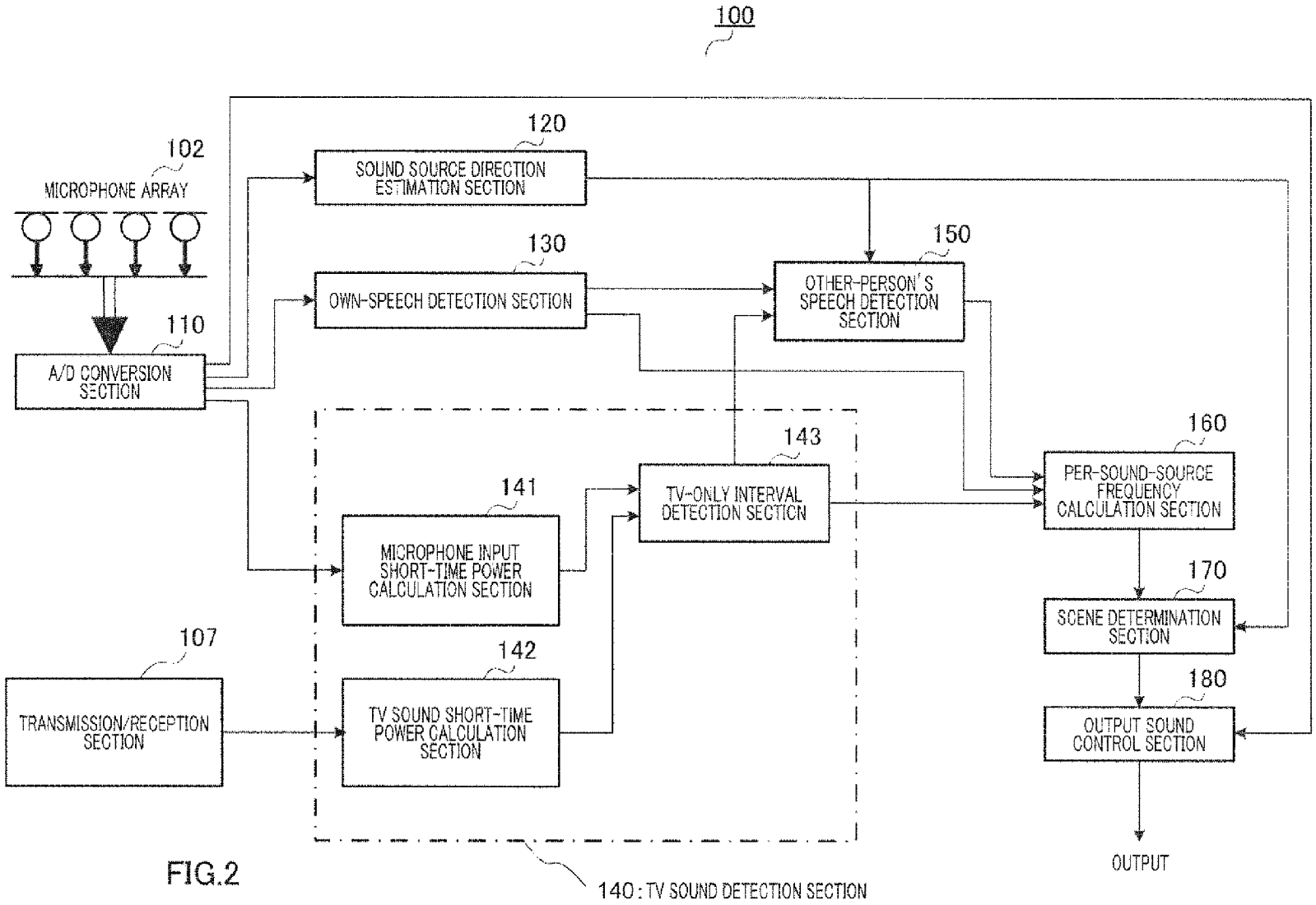
FIG. 2 is a block diagram showing a principal-part configuration of a hearing aid according to the above embodiment.

FIG. 2 is a block diagram showing a principal-part configuration of hearing aid 100 according to this embodiment.

As shown in FIG. 2, hearing aid 100 is provided with microphone array 102, A/D (Analog to Digital) conversion section 110, sound source direction estimation section 120, own-speech detection section 130, TV sound detection section 140, other-person's speech detection section 150, per-sound-source frequency calculation section 160, scene determination section 170, and output sound control section 180.

TV sound detection section 140 comprises microphone input short-time power calculation section 141, TV sound short-time power calculation section 142, and TV-only interval detection section 143.

Microphone array 102 is a sound pickup apparatus in which a plurality of microphones are arrayed. Hearing aid 100 is worn with microphone arrays 102 provided for both ears.

A/D conversion section 110 converts a sound signal input from microphone array 102 to a digital signal.

Sound source direction estimation section 120 detects a sound source direction from an A/D-converted sound signal.

Own-speech detection section 130 detects a hearing aid user's voice from an A/D-converted sound signal.

TV sound detection section 140 detects TV sound from an A/D-converted sound signal. In the description of this embodiment, a TV is used as an example of a sound source that is routinely present in a household. A signal detected by TV sound detection section 140 may of course be TV sound, or may be a sound signal of an AV device of some kind, other than TV sound. Such AV devices include, for example, a BD (Blu-ray Disc)/DVD (Digital Versatile Disk) apparatus or a streaming data playback apparatus using broadband transmission. In the following specification, TV sound is used as a generic term for sound received from any of a variety of AV devices, including TV sound.

Microphone input short-time power calculation section 141 calculates short-time power of a sound signal converted by A/D conversion section 110.

TV sound short-time power calculation section 142 calculates short-time power of received TV sound.

TV-only interval detection section 143 decides a TV-only interval using received TV sound and a sound signal converted by A/D conversion section 110. To be precise, TV-only interval detection section 143 compares TV sound short-time power with microphone input short-time power, and detects an interval for which the difference is within a predetermined range as a TV-only interval.

Other-person's speech detection section 150 detects speech of a speaker other than the wearer using detected sound source direction information, the own-speech detection result, and the TV sound detection result.

Per-sound-source frequency calculation section 160 calculates the frequency of each sound source using the own-speech detection result, TV sound detection result, other-speaker's speech detection result, and sound source direction information.

Scene determination section 170 determines a scene using sound source direction information and the per-sound-source frequency. Scene types include a "conversation scene" in which the wearer is engaged in conversation, a "TV viewing scene" in which the wearer is watching TV, and a "'TV viewing while . . . ' scene" in which the wearer is simultaneously engaged in conversation and watching TV.

Output sound control section 180 processes sound input from a microphone so as to make the sound easier for the user to hear, and controls hearing of hearing aid 100, according to a scene determined by scene determination section 170. Output sound control section 180 controls hearing of hearing aid 100 by means of directivity control. In a "conversation scene," for example, output sound control section 180 orients a directivity beam in a frontal direction. In a "TV viewing scene," output sound control section 180 orients a directivity beam in a frontal direction. Furthermore, in a "TV viewing scene," output sound control section 180 outputs TV sound received by a TV sound reception section. In a "'TV viewing while . . . ' scene," output sound control section 180 controls wide directivity. In this case, in a "'TV viewing while . . . ' scene," output sound control section 180 outputs TV sound received by a TV sound reception section to one ear, and outputs sound with wide directivity to the other ear.

The operation of hearing aid 100 configured as described above will now be explained.

Figures 3, 3A, 3C:
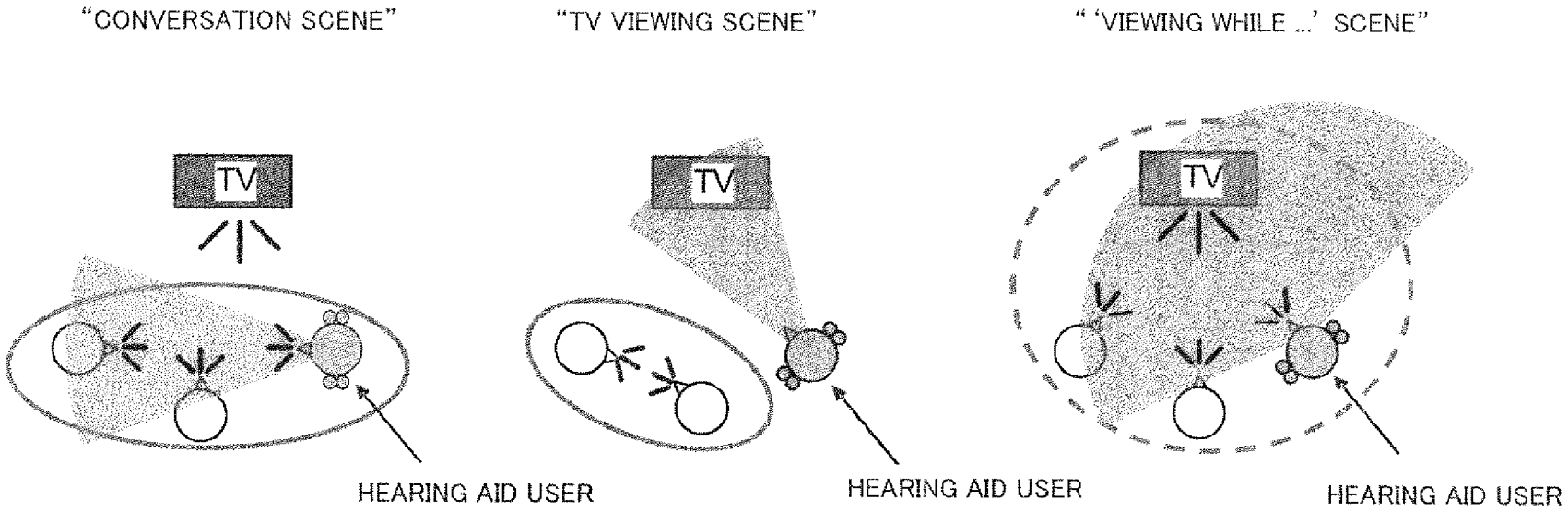
FIG. 3 is a drawing showing positional relationships among a hearing aid user wearing a hearing aid according to the above embodiment in his/her ears, a TV, and persons engaged in conversation.

FIG. 3 shows examples of the use of hearing aid 100.

FIG. 3 is a drawing showing positional relationships among a hearing aid user wearing a hearing aid in his/her ears, a TV, and persons engaged in conversation.

In FIG. 3 (*a*), the TV is on, but the hearing aid user is engaged in conversation with family members and is not particularly watching the TV. This scene will be called a "conversation scene." TV sound flows from a TV speaker on the right of the hearing aid user, and the hearing aid user is engaged in conversation with persons directly in front, and in front and to the left. In this "conversation scene," TV sound interferes with the conversation and makes conversation difficult, and it is therefore desirable to perform control that orients directivity forward.

In FIG. 3 (*b*), the positions of the persons and the TV are the same as in FIG. 3 (*a*), but the hearing aid user is watching TV while family members to the left are engaged in conversation. This scene will be called a "TV scene." In this "TV scene," the conversation between family members is a disturbance making it difficult to hear the TV sound directly, and it is therefore necessary for the hearing aid user to manually perform a switching operation to output TV sound directly from the hearing aid. In this "TV scene," it is desirable for this switching to be performed automatically, or for directivity to be oriented forward, in the direction of the TV.

In FIG. 3 (*c*), the positions of the persons and the TV are the same as in FIGS. 3 (*a*) and (*b*), but the hearing aid user is watching TV while discussing the TV program with family members to the side. This scene will be called a "' viewing while . . . ' scene." In this "'viewing while . . . ' scene," it is necessary to hear both the TV sound and the sound of the voices of those engaged in conversation, rather than one sound or the other. Normally, this kind of conversation about a TV program is often conducted when TV sound has been interrupted, and therefore both TV sound and the voices of those engaged in conversation can be heard by providing non-directional sound or sound with wide directivity.

Figure 4:
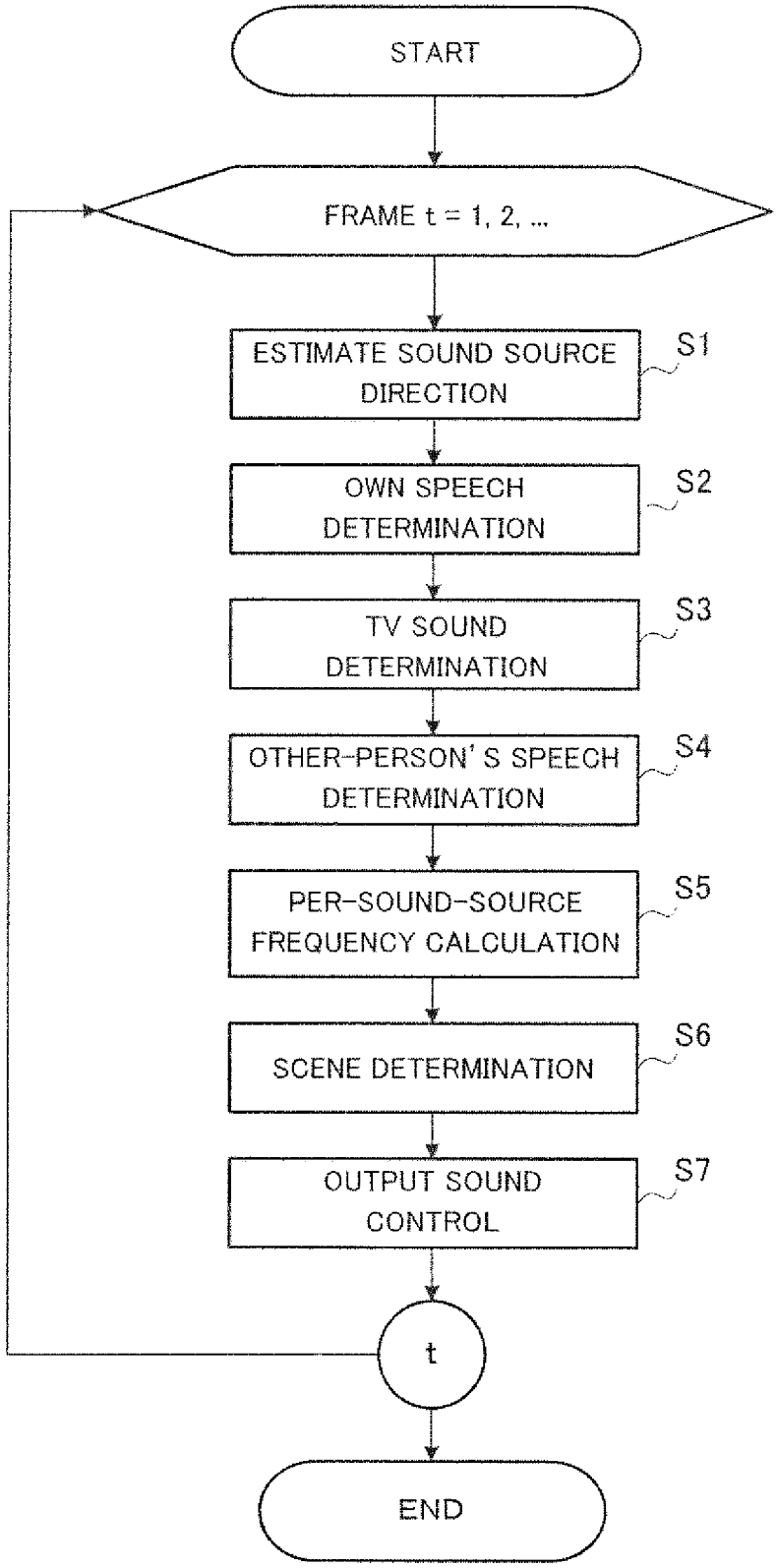
FIG. 4 is a flowchart showing the processing flow of a hearing aid according to the above embodiment.

FIG. 4 is a flowchart showing the processing flow of hearing aid 100. This processing flow is executed by CPU 106 at respective predetermined timings.

Sound picked up by microphone array 102 is converted to a digital signal by A/D conversion section 110, and is output to CPU 106. CPU 106 executes the processing in step S1 through step S7 every frame (=1 second), which is a short-time unit.

[Sound Source Direction Estimation]

In step S1, sound source direction estimation section 120 estimates a sound source direction by performing signal processing using a difference between times at which sound arrives at each microphone from an A/D-converted sound source, and outputs this estimated sound source direction. Sound source direction estimation section 120 first finds a direction of a sound source every 512 points with 22.5° resolution for a sound signal sampled at a sampling frequency of 48 kHz. Next, sound source direction estimation section 120 outputs a direction represented by the highest frequency within a 1-second frame as an estimated direction of that frame. Sound source direction estimation section 120 can obtain a sound source direction estimation result every second.

Next, a description will be given of results of picking up ambient sound with hearing aid microphone array 102 actually worn on both ears and performing a sound source direction estimation experiment for a scene in which a hearing aid user is watching TV while engaging in conversation with persons to one side as shown in FIG. 3 (*c*).

Figure 5:
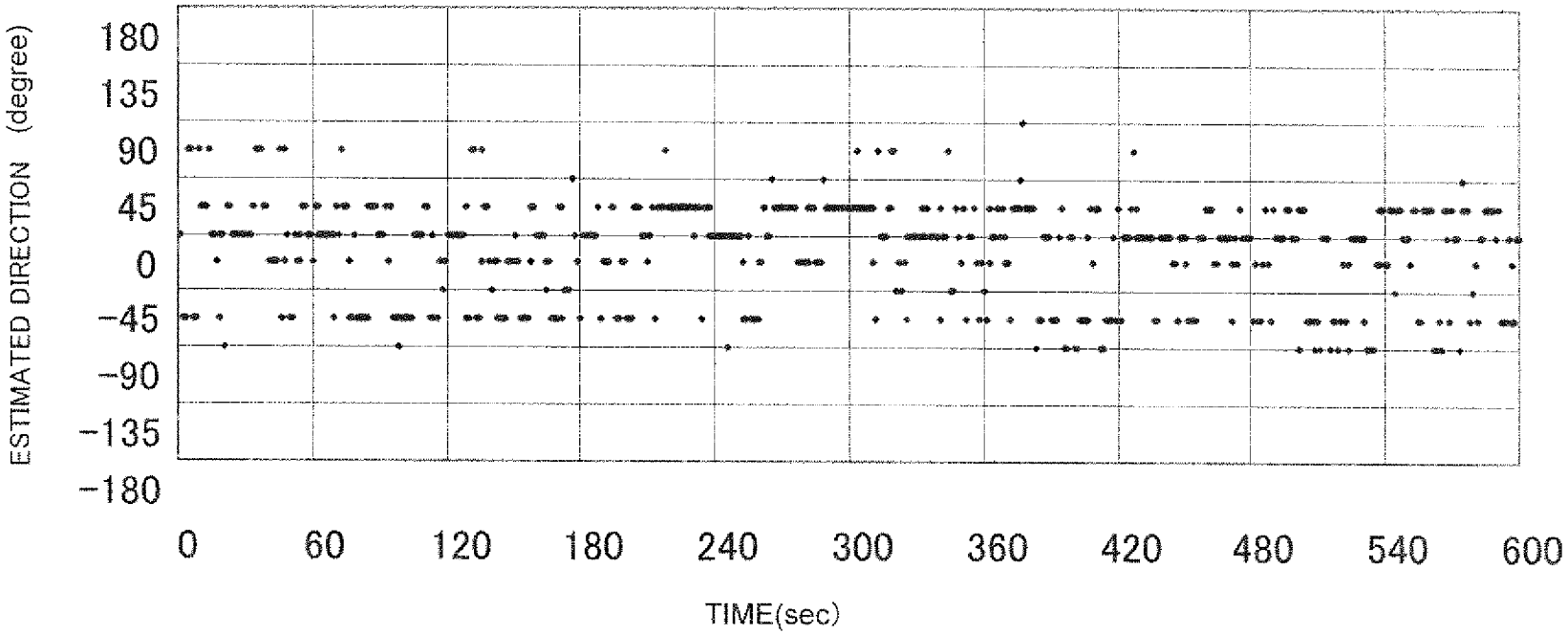
FIG. 5 is a drawing showing sound source direction estimation experimental results for a hearing aid according to the above embodiment.

FIG. 5 shows results output by sound source direction estimation section 120 at this time.

FIG. 5 is a drawing showing sound source direction estimation experimental results, with the horizontal axis representing time (seconds) and the vertical axis representing direction. Direction is output in 22.5° steps from −180° to +180°, taking the frontal direction of the hearing aid user as 0°, the leftward direction as negative, and the rightward direction as positive.

As shown in FIG. 5, sound source direction estimation experimental results include estimation error in addition to the fact that sound output from a TV speaker directly in front of the hearing aid user and the voices of those being engaged in conversation to the left of the hearing aid user are mixed together. Consequently, what kind of sound source is in which direction is not known from this information alone.

[Own-Speech Detection]

In step S2, own-speech detection section 130 determines from an A/D-converted sound signal whether or not a sound signal in frame t is an own-speech interval, and outputs the result. As an own-speech detection method, there is, as a known technology, a method whereby own speech is detected by detecting speech vibrations due to bone conduction as in Patent Literature 3, for example. Using such a method, own-speech detection section 130 takes an interval for which a vibration component is greater than or equal to a predetermined threshold value as an own-speech utterance interval on a frame-by-frame basis.

[TV Sound Detection]

In step S3, TV sound detection section 140 uses an A/D-converted sound signal and an external TV sound signal received by transmission/reception section 107 (FIG. 1) to determine whether or not an ambient sound environment in frame t is a state in which only TV sound is being emitted, and outputs the result.

TV sound detection section 140 comprises microphone input short-time power calculation section 141, TV sound short-time power calculation section 142, and TV-only interval detection section 143. Microphone input short-time power calculation section 141 calculates short-time power of a sound signal picked up by microphone array 102. TV sound short-time power calculation section 142 calculates short-time power of received TV sound. TV-only interval detection section 143 compares these two outputs, and detects an interval for which the difference between them is within a predetermined range as a TV-only interval.

The TV sound detection method will now be described.

Normally, sound output from a TV speaker is delayed and has reflected sound and so forth mixed in with it during transmission through space to a hearing aid microphone, so that it is no longer the same as the original TV sound. Since delay also occurs in TV sound transmitted by means of a radio wave, there is a problem of unknown delay having to be considered and the amount of computation increasing when finding the correlation between sound picked up by a microphone and original TV sound.

Thus, in this embodiment, sound picked up by a microphone and original TV sound are compared using approximately 1-second short-time power that allows delay to be ignored. By this means, this embodiment makes is possible for TV sound detection to be performed with a small amount of computation independently of the distance from the TV, the room environment, and radio communication conditions.

Microphone input short-time power calculation section 141 uses equation 1 below to calculate power Pm(t) in a frame t 1-second interval for a sound signal of at least one non-directional microphone in microphone array 102. In equation 1, Xi represents a sound signal, and N represents a number of samples in 1 second. When the sampling frequency is 48 kHz, N=48000.

(Equation 1)

$$Pm(t)=\Sigma(xi^2)/N \quad [1]$$

Similarly, TV sound short-time power calculation section 142 uses equation 2 below to calculate power Pt(t) in a 1-second interval for an external TV sound signal received by transmission/reception section 107. Here, yi represents a TV sound signal.

(Equation 2)

$$Pt(t)=\Sigma(yi^2)/N \quad [2]$$

Then level difference Ld(t) between microphone input sound and TV sound in frame t is found by means of equation 3 below.

$$Ld(t)=\log(Pm)-\log(Pt) \quad \text{(Equation 3)}$$

Next, a description will be given of results of performing a TV sound detection experiment for a scene in which a hearing aid user is watching TV while engaging in conversation with persons to one side as shown in FIG. 3 (*c*). Specifically, a TV sound detection experiment was conducted in which, in the scene in FIG. 3 (*c*), ambient sound was picked up by hearing aid microphone array 102 actually worn on both ears and TV source sound was also simultaneously recorded.

Figure 6:
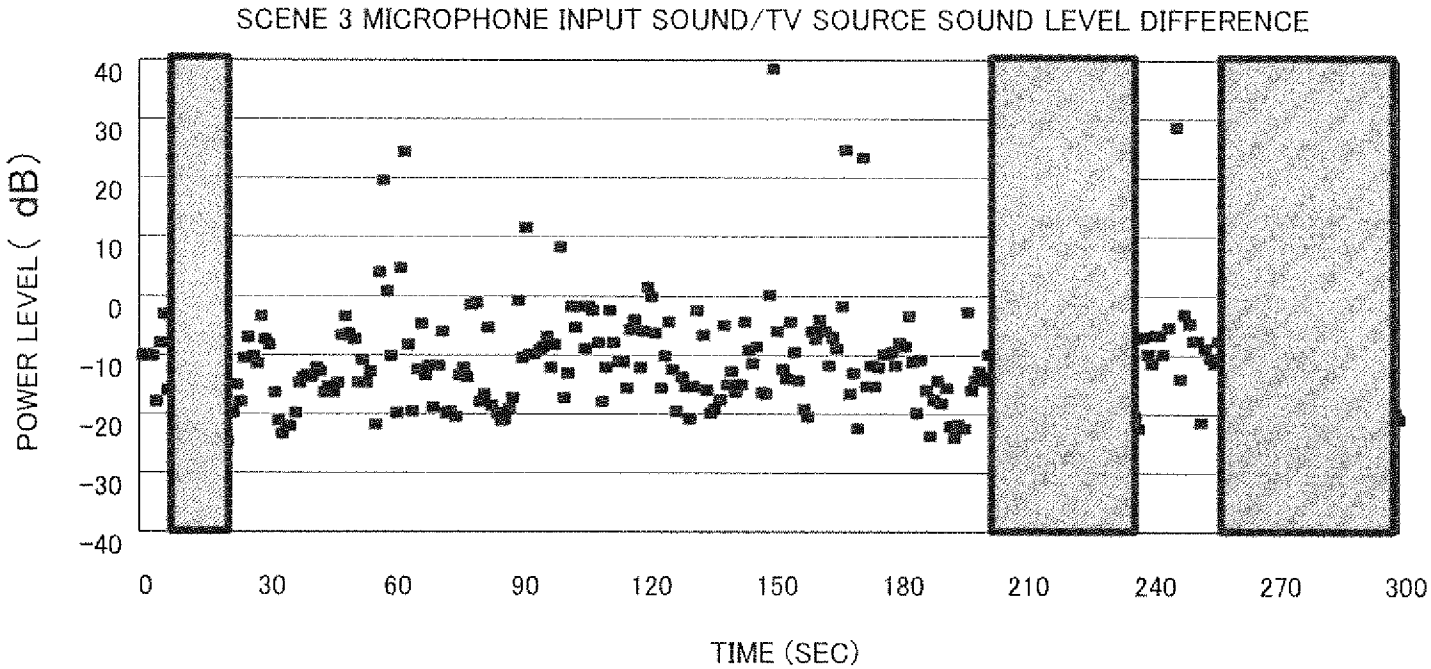
FIG. 6 is a drawing showing TV sound detection experimental results for a hearing aid according to the above embodiment.

FIG. 6 is a drawing showing TV sound detection experimental results, with the horizontal axis representing time (seconds) and the vertical axis representing the power level difference (dB).

FIG. 6 shows per-second power difference Ld between sound picked up by microphone array 102 and TV sound. Shaded areas enclosed by rectangles in FIG. 6 indicate intervals labeled by listeners as TV-only intervals. In an interval with a nonsteady sound other than TV sound—that is, the voice of a person engaged in conversation or one's own voice—power level difference Ld(t) varies. However, it can be seen that in a TV-only interval with no sound source other than TV sound, this power level difference is a value in the vicinity of −20 dB. From this, it can be seen that, for a TV-only interval, an interval in which only TV sound is emitted can be identified by taking a per-second power level difference as a feature amount. Thus, TV sound detection section 140 detects an interval for which power level difference Ld(t) is a value of −20±θ dB as a TV-only interval.

Since this value of −20 dB differs according to the environment, it is desirable far it to be learned automatically by monitoring power level differences over a long period. Even if there is a steady noise such as the sound of a fan in the surrounding area, since there is no time variation in power in a steady noise, a power level difference in the vicinity of a fixed value is indicated, and it is possible for TV sound detection section 140 to perform TV-sound-only interval detection.

Since TV sound also includes human voices, identification as a live human voice is not possible simply by means of speech quality that indicates a likelihood of being a human voice rather than noise or music. However, in this embodiment, an interval in which there is only TV sound can be detected with a small amount of computation, independently of the distance from the TV or the room environment, by performing a short-time power comparison using TV source sound in this way.

[Other-Person's Speech Detection]

In step S4, other-person's speech detection section 150 excludes an own-speech interval detected by own-speech detection section 130 and an interval detected by TV-only interval detection section 143 from per-direction output results output by sound source direction estimation section 120. Furthermore, other-person's speech detection section 150 outputs an interval for which voice-band power of at least one non-directional microphone is greater than or equal to a predetermined threshold value as an other-person's speech interval from intervals excluding an own-speech interval and TV-only interval. For an other-person's speech interval, noise that is not a human voice can be eliminated by limitation to a place where voice-band power is high. Here, speech quality detection has been assumed to be based on voice-band power, but another method may also be used.

Figure 7:
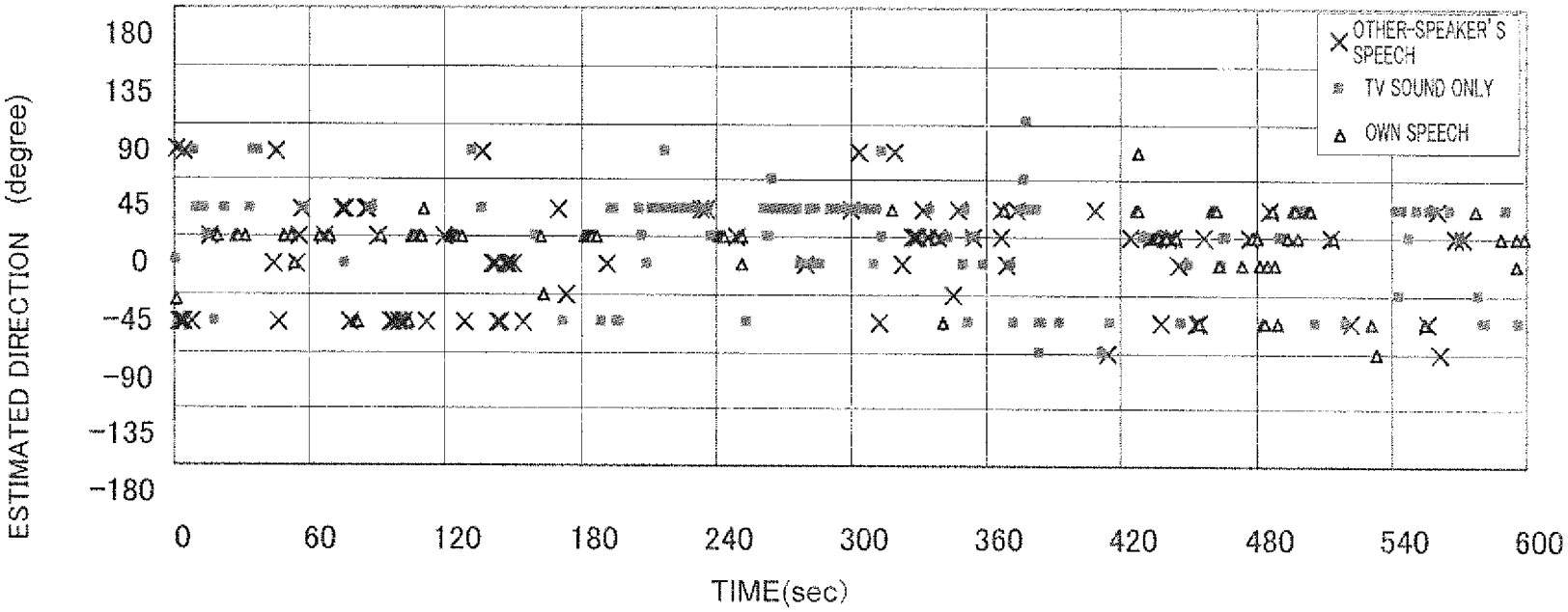
FIG. 7 is a drawing in which are plotted the results of performing own speech, TV-only sound, and other-person's speech determination for per-frame sound source direction estimation results of a hearing aid according to the above embodiment.

FIG. 7 is a drawing in which are plotted the results of performing own speech, TV-only sound, and other-person's speech determination for the per-frame sound source direction estimation results shown in FIG. 5.

As shown in FIG. 7, it can be seen for example that, generally, own speech is mainly detected in the vicinity of 0°, and TV sound is detected between 22.5° to the right and 22.5° to the left of a hearing aid user. While the volume of TV sound, the speaker arrangement, and the positional relationship between the hearing aid user and the TV are also influencing factors, in this experiment a hearing aid user picked up sound when watching a 42-inch TV with left and right stereo speakers from a distance of 1 to 2 meters. This experiment simulates an actual home environment.

Normally, a speaker directly in front and the mouth of a hearing aid user are equidistant from the microphones of both ears, and therefore sound source direction estimation results are detected in a 0° direction.

In this embodiment, through combination with own-speech detection, it is possible to determine whether a frontal-direction sound is own speech or other-person's speech. Furthermore, in this embodiment, through combination with TV sound detection, when there is speech other than own speech directly in front, it can be determined whether that is the voice of a person on TV or the live voice of an actual person.

[Per-Sound-Source Frequency Calculation]

In step S5, per-sound-source frequency calculation section 160 uses own-speech detection section 130, TV-only interval detection section 143, and other-person's speech detection section 150 output results to calculate frequency over a long period for the respective sound sources.

Figure 8:
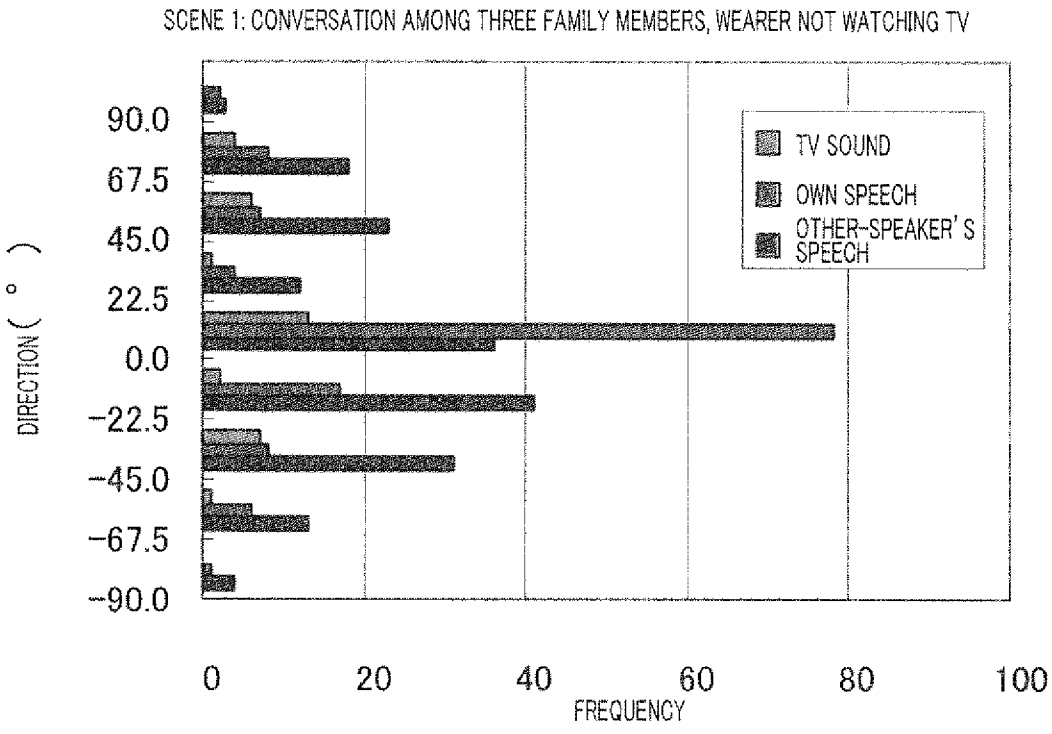
FIG. 8 is a drawing showing "conversation scene" frequency by sound source of a hearing aid according to the above embodiment.
Figure 9:
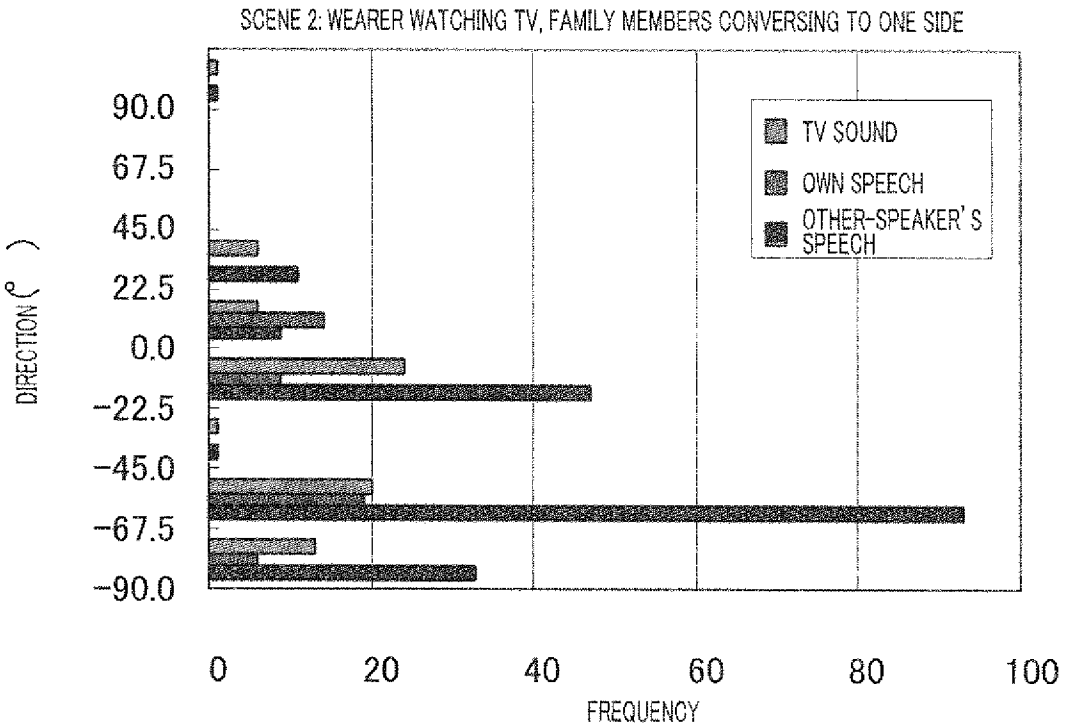
FIG. 9 is a drawing showing "TV scene" frequency by sound source of a hearing aid according to the above embodiment.
Figure 10:
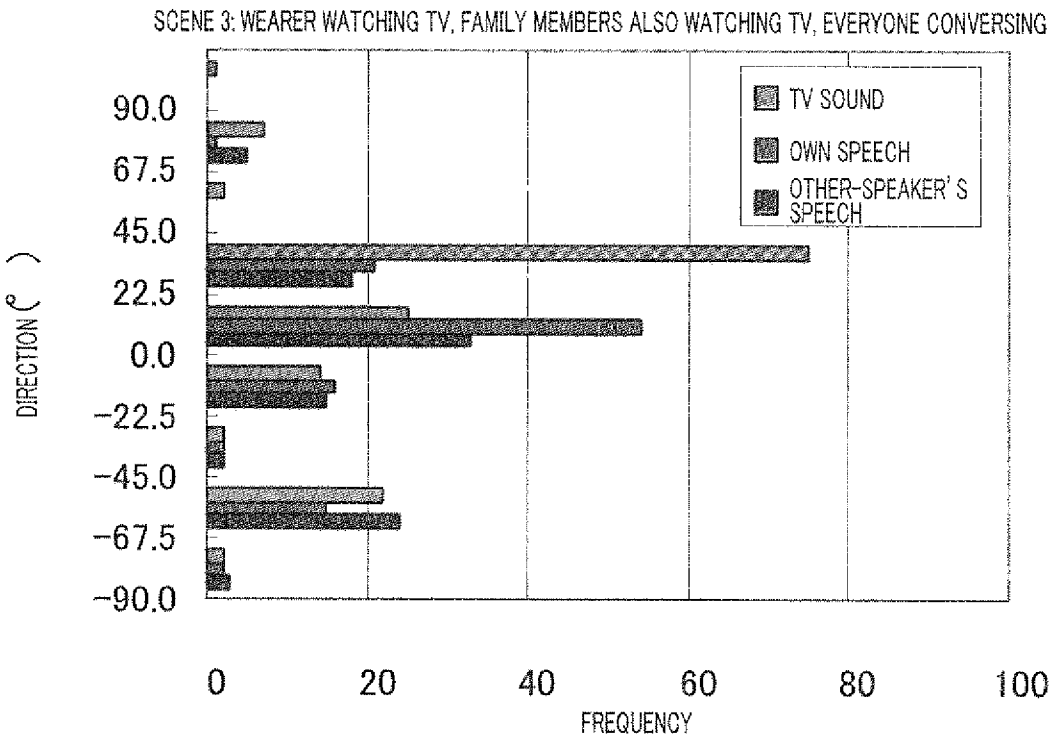
FIG. 10 is a drawing showing "'viewing while . . . ' scene" frequency by sound source of a hearing aid according to the above embodiment.

FIG. 8 through FIG. 10 are drawings in which, based on own-speech detection, TV-only interval detection, and other-person's speech detection performed using ambient sound picked up by hearing aid microphone arrays actually worn on both ears and simultaneously recorded TV source sound for the scenes in FIGS. 3 (*a*), (*b*), and (*c*), frequency of appearance in a 10-minute interval is found for each sound source.

FIG. 8 is a "conversation scene" per-sound-source frequency graph, FIG. 9 is a "TV scene" per-sound-source frequency graph, and FIG. 10 is a "'viewing while . . . ' scene" per-sound-source frequency graph.

As shown in FIG. 8 through FIG. 10, the following kinds of features appear as features of a "conversation scene," "TV scene," and "'viewing while . . . ' scene," respectively.

[Scene Features]

In a "conversation scene," since a hearing aid user himself/herself participates in a conversation, own speech in a frontal direction is frequently detected, and since the hearing aid user talks while looking in the direction of a conversation partner, a conversation partner's voice is also detected in the vicinity of the frontal direction. However, since own speech is also detected in the frontal direction, a conversation partner's voice is not detected so frequently in relative terms. Also, since conversation proceeds without relation to what is on TV, a feature that appears is that speakers do not fall silent in order to watch TV, and consequently TV-only intervals are short.

In a "TV scene," a hearing aid user does not participate in a conversation, and therefore own speech is scarcely detected. Since the hearing aid user is facing the TV in order to watch the TV screen, TV sound is detected in a direction close to directly in front. Other-person's speech is detected other than directly in front, and moreover, the amount of such speech is large. In a "conversation scene" there is own speech and other-person's speech in the frontal direction, but the amount of other-person's speech is relatively small, whereas in a "TV scene" there is a speaker in a different direction from own speech, and therefore more other-person's speech is detected than in a "conversation scene." Also, since conversation carried on to one side is conducted without relation to what is on TV, a feature that appears is that speakers do not fall silent in order to watch TV, and consequently TV-only intervals are short even though this is a scene in which the TV is being watched.

In a "'viewing while . . . ' scene," a hearing aid user himself/herself participates in a conversation, and therefore own speech in a frontal direction is frequently detected. Since the hearing aid user is facing the TV in order to watch the TV screen, TV sound is detected in a direction close to directly in front, and other-person's speech is detected in a direction other than directly in front. Moreover, in a "viewing while . . . " case, time during which the hearing aid user and another person are silent and watching TV becomes somewhat longer, and there appears a tendency to discuss what is on TV when TV sound is interrupted. Consequently, a feature is that TV-only time becomes longer.

FIG. 11 summarizes these features.

FIG. 11 is a drawing showing a table indicating scene features.

Per-sound-source frequency calculation section 160 can determine a scene from a sound environment by utilizing features shown in the table in FIG. 11. Shaded areas in the table indicate particularly characteristic parameters for the relevant scene.

Here, frequency in a past 10-minute interval is found from frame t in order to ascertain tendencies in scene features, but a shorter interval may actually be used to track real movements.

[Scene Determination]

In step S6, scene determination section 170 performs scene determination using the per-sound-source frequency information and direction information for each sound source.

Whether or not TV power is on can be determined by whether or not TV sound is being received. However, it is necessary for scene determination section 170 to determine automatically whether or not a hearing aid user is watching TV, conversing without watching TV, or conversing with a family member while watching TV, at that time. Scene determination is performed by scoring by means of a point addition method such as described below.

FIG. 12 is a drawing representing an example of scene determination by means of a point addition method.

As shown in FIG. 12, Fs indicates the frequency of own speech detected in a 0° direction within a past fixed period from frame t, Dt indicates a direction in which the frequency of TV-only sound is highest as the TV direction, and Ft indicates the frequency at that time. A direction in which the frequency of other-person's speech is highest is taken as an other-person's speech direction and Dp, and Fp indicates the frequency at that time. The frequency determination threshold value is designated θ. Taking FIG. 12 as an example, scene determination scores according to a point addition method are as follows.

When $Fs \geq \theta$, 10 points each are added to a "conversation scene" score and a "'viewing while . . . ' scene" score.

When $Fs < \theta$, 10 points each are added to a "TV scene" score.

When $|Dp| \leq 22.5°$, 5 points are added to a "conversation scene" score.

When $|Dp| > 22.5°$, 5 points each are added to a "TV scene" score and a "'viewing while . . . ' scene" score.

When $|Dp| > 22.5°$ and $Fp \geq \theta$, 5 points are further added to a "TV scene" score.

When $|Dt| \leq 22.5°$, 5 points are added to a "conversation scene" score.

When $|Dt| \leq 22.5°$, 5 points each are added to a "TV scene" score and a "'viewing while . . . ' scene" score.

When $|Dt| \leq 22.5°$ and $Ft \geq \theta$, 5 points are further added to a "'viewing while . . . ' scene" score.

In the above-described way, a "conversation scene" score, "TV scene" score, and "'viewing while . . . ' scene" score are found, and a scene for which the value is largest and the score is greater than or equal to threshold value λ is taken as a determination result. If scores are less than λ, a "no scene" result is output.

Here, scoring is performed such that a large point addition is made for a parameter that well represents a feature of a scene. Also, point deduction is not performed even in the event of erroneous detection so that a scene can be detected even if all feature amounts are not detected correctly.

When threshold value θ for frequency in a past 10-minute interval=40, and score threshold value λ=15, if the kind of per-sound-source frequency distribution shown in FIG. 8 has been obtained, scene scores are as follows.

"Conversation scene" score=10+5+5=20

"TV scene" score=0

"'Viewing while . . . ' scene" score=0

Consequently, since the highest score—the "conversation scene" score of 20—is greater than or equal to predetermined threshold value λ, scene determination section 170 outputs a "conversation scene" result.

If the kind of per-sound-source frequency distribution shown in FIG. 9 has been obtained, scene scores are as follows.

"Conversation scene" score=0

"TV scene" score=10+5+5+5=25

"'Viewing while . . . ' scene" score=5+5=10

Consequently, since the highest score—the "TV scene" score of 25—is greater than or equal to predetermined threshold value λ, scene determination section 170 outputs a "TV scene" result.

If the kind of per-sound-source frequency distribution shown in FIG. 10 has been obtained, scene scores are as follows.

"Conversation scene" score=10

"TV scene" score=5+5=10

"'Viewing while . . . ' scene" score=10+5+5+5=25

Consequently, since the highest score the "'viewing while . . . ' scene" score of 25—is greater than or equal to predetermined threshold value λ, scene determination section 170 outputs a "'viewing while . . . ' scene" result.

Scene determination scoring is not limited to the kind of point addition method described above. A threshold value may be changed according to respective feature values, and point addition may also be performed with threshold values divided into a number of steps.

Figure 13:
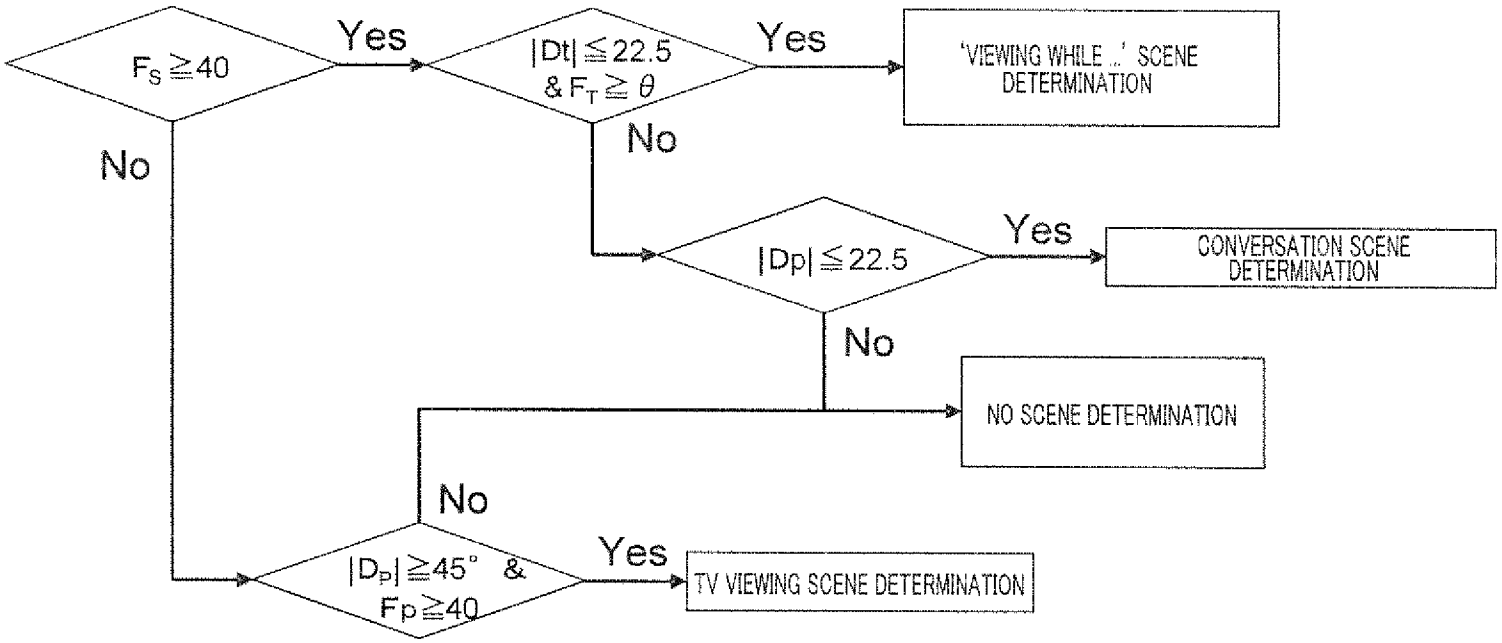
FIG. 13 is a drawing representing an example of rule-based scene determination of a hearing aid according to the above embodiment.

Also, scene determination section 170 may assign a score through the design of a frequency-dependent function, or make a rule-based determination, instead of adding points to a score based on a threshold value. FIG. 13 shows an example of a rule-based determination method.

FIG. 13 is a drawing representing an example of rule-based scene determination.

[Output Sound Control]

In step S7, output sound control section 180 controls output sound according to a scene determined by scene determination section 170.

When a "conversation scene" determination has been made, processing that orients directivity in the frontal direction is performed.

When a "TV scene" determination has been made, hearing aid speaker output is switched to externally input TV sound. Alternatively, frontal-direction directivity control may be performed.

When a "'viewing while . . . ' scene" determination has been made, control is performed to provide wide directivity.

If no scene determination has been made, wide directivity or non-directivity is decided upon.

Also, output sound control section 180 performs hearing enhancement processing, such as amplifying the acoustic pressure of a frequency band that is difficult to hear, according to the degree of hearing impairment of a hearing aid user, and outputs the result from a speaker.

As described in detail above, hearing aid 100 of this embodiment is provided with A/D conversion section 110 that converts a sound signal input from microphone array 102 to a digital signal, sound source direction estimation section 120 that detects a sound source direction from the sound signal, own-speech detection section 130 that detects a hearing aid user's voice from the sound signal, and TV sound detection section 140 that detects TV sound from the sound signal. Hearing aid 100 is also provided with other-person's speech detection section 150 that detects speech of a speaker other than the wearer using detected sound source direction information, the own-speech detection result, and the TV sound detection result, and per-sound-source frequency calculation section 160 that calculates the frequency of each sound source based on an own-speech detection result, TV sound detection result, other-speaker's speech detection result, and sound source direction information. Scene determination section 170 determines a scene to be a "conversation scene," "TV viewing scene," or "'TV viewing while . . . ' scene," using sound source direction information and the per-sound-source frequency. Output sound control section 180 controls hearing of hearing aid 100 according to a determined scene.

By this means, this embodiment suppresses ambient TV sound and focuses directivity in a frontal direction when conversation is being carried on without the TV being watched, facilitating conversation with a person in front. Also, when a hearing aid user is concentrating on the TV, hearing aid output is automatically switched to TV sound, making TV sound easier to be heard without the need to perform a troublesome operation. Furthermore, when a hearing aid user is watching TV while engaging in conversation, wide directivity is set. Consequently, when everyone is silent, the sound of the TV can be heard, and when someone speaks, neither sound is suppressed and both can be heard.

Thus, in this embodiment, a scene can be determined appropriately by using not only a sound source direction but also a sound source type (TV sound, own speech, or other-person's speech), frequency information, and time information. In particular, this embodiment can handle a case in which a user wishes to hear both TV sound and conversation by means of "'viewing while . . . ' scene" determination.

The above description presents an example of a preferred embodiment of the present invention, but the scope of the present invention is not limited to this.

For example, the present invention can also be applied to a hearing aid that controls the volume of a TV.

Figure 14:
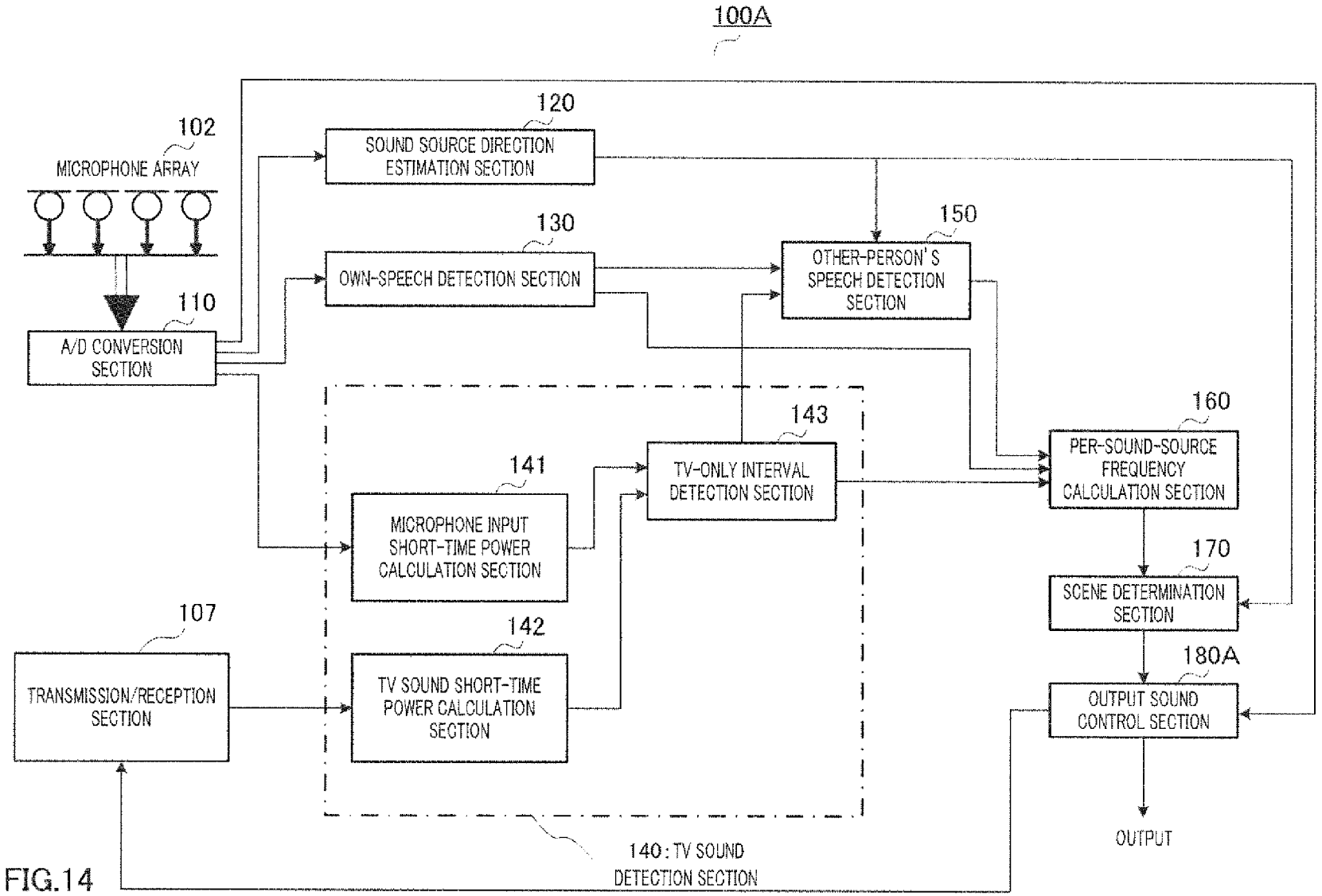
FIG. 14 is a drawing showing the configuration of a hearing aid that controls the volume of a TV according to the above embodiment.

FIG. 14 is a drawing showing the configuration of a hearing aid that controls the volume of a TV. Configuration parts in FIG. 14 identical to those in FIG. 2 are assigned the same reference codes as in FIG. 2.

As shown in FIG. 14, hearing aid 100A that controls the volume of a TV is provided with microphone array 102, A/D conversion section 110, sound source direction estimation section 120, own-speech detection section 130, TV sound detection section 140, other-person's speech detection section 150, per-sound-source frequency calculation section 160, scene determination section 170, and output sound control section 180A.

Output sound control section 180A generates a TV sound control signal that controls the volume of a TV based on a scene determination result from scene determination section 170.

Transmission/reception section 107 transmits a TV sound control signal generated by output sound control section 180A to a TV.

It is desirable for the TV sound control signal to be transmitted by means of Bluetooth or suchlike radio communication, but transmission by means of infrared radiation may also be used.

By this means, an effect is produced of enabling a TV of the present invention to perform volume output in accordance with a scene determined by hearing aid 100A.

The present invention can also be applied to a device other than a TV. Examples of devices other than a TV include a radio, audio device, personal computer, and so forth. The present invention receives sound information from a device other than a TV, and determines whether a scene is one in which a user is listening to sound emitted from that device, is engaged in conversation, or is listening while engaged in conversation. Furthermore, the present invention may also control output sound according to the determined scene.

The present invention can also be implemented as application software of a mobile device. For example, the present invention can determine a scene from sound input from a microphone array installed in a high-functionality mobile phone and sound information transmitted from a TV, and control output sound provided to the user according to that scene.

In this embodiment, the terms "hearing aid" and "signal processing method" have been used, but this is simply for convenience of description, and terms such as "hearing enhancement apparatus" or "speech signal processing apparatus" for an apparatus, and "scene determination method" or the like for a method, may also be used.

The above-described signal processing method is implemented by a program for causing this signal processing method to function. This program is stored in a computer-readable recording medium.

The disclosure of Japanese Patent Application No. 2010-139726, filed on Jun. 18, 2010, including the specification, drawings and abstract, is incorporated herein by reference in its entirety.

A hearing aid and signal processing method according to the present invention are suitable for use in a hearing aid that makes a desired sound easier to hear for a hearing aid user. The present invention is also suitable for use as application software of a mobile device such as a high-functionality mobile phone.

REFERENCE SIGNS LIST

100, 100A Hearing aid
101 Hearing aid housing
102 Microphone array
103 Speaker
104 Ear tip
105 Remote control apparatus
106 CPU
107 Transmission/reception section
108 Audio transmitter
109 TV
110 A/D conversion section
120 Sound source direction estimation section
130 Own-speech detection section
140 TV sound detection section
141 Microphone input short-time power calculation section
142 TV sound short-time power calculation section
143 TV-only interval detection section
150 Other-person's speech detection section
160 Per-sound-source frequency calculation section
170 Scene determination section
180, 180A Output sound control section

The invention claimed is:

1. A hearing aid worn on both ears which has two microphone arrays respectively for both of the ears, the hearing aid comprising:

a sound source direction estimation section that detects a sound source direction from sound signals input from the microphone arrays;

an own-speech detection section that detects a voice of a hearing aid wearer from the sound signal;

a TV sound detection section that detects TV sound from the sound signal;

another-speaker's speech detection section that detects speech of a speaker other than a wearer based on the detected sound source direction information, the own-speech detection result, and the TV sound detection result;

a per-sound-source frequency calculation section that calculates, in each direction and for each sound source, a per-sound-source frequency which indicates how often the sound source is detected per predetermined time, based on the own-speech detection result, the TV sound detection result, the other-speaker's speech detection result, and the sound source direction information;

a scene determination section that determines a scene using the sound source direction information and the per-sound-source frequency; and an output sound control section that controls a sound output from the hearing aid according to the determined scene, wherein the scene determination section performs scene classification for a "conversation scene" in which a wearer is engaged in conversation, a "TV viewing scene" in which a wearer is watching TV, and a "TV viewing while conversation scene" in which a wearer is simultaneously engaged in conversation and watching TV, and the output sound control section orients a directivity beam in a frontal direction in the "conversation scene".

2. The hearing aid according to claim 1, wherein the TV sound detection section further comprises: a TV sound reception section that receives TV sound information transmitted from the TV; and a TV-only interval detection section that detects a TV-only interval based on received TV sound and the sound signal.

3. The hearing aid according to claim 1, wherein:

the TV sound detection section further comprises:

a TV sound reception section that receives TV sound information transmitted from the TV;

a TV sound short-time power calculation section that calculates short-time power of received TV sound;

a microphone input short-time power calculation section that calculates short-time power of the sound signal; and a TV-only interval detection section that compares the TV sound short-time power and the microphone input short-time power, and detects an interval for which a difference therebetween is within a predetermined range as a TV-only interval.

4. The hearing aid according to claim 1, wherein the output sound control section performs directivity control.

5. The hearing aid according to claim 1, wherein the output sound control section outputs TV sound received by the TV sound reception section in a "TV viewing scene".

6. The hearing aid according to claim 1, wherein the output sound control section sets wide directivity in a "TV viewing while conversation' scene".

7. A signal processing method that is a signal processing method of a hearing aid worn on both ears which has two microphone arrays respectively for both of the ears, the signal processing method comprising:

detecting a sound source direction from sound signals input from the microphone arrays;

detecting a voice of a hearing aid wearer from the sound signal;

detecting TV sound from the sound signal;

detecting speech of a speaker other than a wearer based on the detected sound source direction information, the own-speech detection result, and the TV sound detection result;

calculating, in each direction and for each sound source, a per-sound-source frequency which indicates how often the sound source is detected per predetermined time, based on the own-speech detection result, the TV sound detection result, the other-speaker's speech detection result, and the sound source direction information;

determining a scene based on the sound source direction information and the per-sound-source frequency; and controlling a sound output from the hearing aid according to the determined scene, wherein, in the determining of the scene, classification for each scene is performed, the each scene having a "conversation scene" in which a wearer is engaged in conversation, a "TV viewing scene" in which a wearer is watching TV, and a "TV viewing while conversation scene" in which a wearer is simultaneously engaged in conversation and watching TV, and in the controlling of the sound output, a directivity beam in a frontal direction in a "conversation scene" is oriented.

8. A program stored on a non-transitory computer readable medium that causes a computer to execute each step of the hearing aid signal processing method according to claim 7.

9. A hearing aid worn on both ears which has two microphone arrays respectively for both of the ears, the hearing aid comprising:

a sound source direction estimation section that detects a sound source direction from sound signals input from the microphone arrays;

an own-speech detection section that detects a voice of a hearing aid wearer from the sound signal;

a TV sound detection section that detects TV sound from the sound signal;

another-speaker's speech detection section that detects speech of a speaker other than a wearer based on the detected sound source direction information, the own-speech detection result, and the TV sound detection result;

a per-sound-source frequency calculation section that calculates, in each direction and for each sound source, a per-sound-source frequency which indicates how often the sound source is detected per predetermined time, based on the own-speech detection result, the TV sound detection result, the other-speaker's speech detection result, and the sound source direction information;

a scene determination section that determines a scene using the sound source direction information and the per-sound-source frequency; and an output sound control section that controls a sound output from the hearing aid according to the determined scene, wherein the scene determination section performs scene classification for a "conversation scene" in which a wearer is engaged in conversation, a "TV viewing scene" in which a wearer is watching TV, and a "TV viewing while conversation scene" in which a wearer is simultaneously engaged in conversation and watching TV, and the output sound control section orients a directivity beam in a frontal direction in a "TV viewing scene".

10. The hearing aid according to claim 9, wherein the TV sound detection section further comprises: a TV sound reception section that receives TV sound information transmitted from the TV; and a TV-only interval detection section that detects a TV-only interval based on received TV sound and the sound signal.

11. The hearing aid according to claim 9, wherein:

the TV sound detection section further comprises:

a TV sound reception section that receives TV sound information transmitted from the TV;

a TV sound short-time power calculation section that calculates short-time power of received TV sound;

a microphone input short-time power calculation section that calculates short-time power of the sound signal; and a TV-only interval detection section that compares the TV sound short-time power and the microphone input short-time power, and detects an interval for which a difference there between is within a predetermined range as a TV-only interval.

12. The hearing aid according to claim 9, wherein the output sound control section performs directivity control.

13. The hearing aid according to claim 9, wherein the output sound control section outputs TV sound received by the TV sound reception section in a "TV viewing scene".

14. The hearing aid according to claim 9, wherein the output sound control section sets wide directivity in a "TV viewing while conversation scene".

15. A signal processing method that is a signal processing method of a hearing aid worn on both ears which has two microphone arrays respectively for both of the ears, the signal processing method comprising:

detecting a sound source direction from sound signals input from the microphone arrays;

detecting a voice of a hearing aid wearer from the sound signal;

detecting TV sound from the sound signal;

detecting speech of a speaker other than a wearer based on the detected sound source direction information, the own-speech detection result, and the TV sound detection result;

calculating, in each direction and for each sound source, a per-sound-source frequency which indicates how often the sound source is detected per predetermined time, based on the own-speech detection result, the TV sound detection result, the other-speaker's speech detection result, and the sound source direction information;

determining a scene based on the sound source direction information and the per-sound-source frequency; and controlling a sound output from the hearing aid according to the determined scene, wherein, in the determining of the scene, scene classification of each scene is performed, the each scene having a "conversation scene" in which a wearer is engaged in conversation, a "TV viewing scene" in which a wearer is watching TV, and a "TV viewing while conversation scene" in which a wearer is simultaneously engaged in conversation and watching TV, and in the controlling of the sound output, a directivity beam in a frontal direction in a "TV viewing scene" is oriented.

16. A program stored on a non-transitory computer readable medium that causes a computer to execute each step of the hearing aid signal processing method according to claim 15.

17. A hearing aid worn on both ears which has two microphone arrays respectively for both of the ears, the hearing aid comprising:

a sound source direction estimation section that detects a sound source direction from sound signals input from the microphone arrays;

an own-speech detection section that detects a voice of a hearing aid wearer from the sound signal;

a TV sound detection section that detects TV sound from the sound signal;

another-speaker's speech detection section that detects speech of a speaker other than a wearer based on the detected sound source direction information, the own-speech detection result, and the TV sound detection result;

a per-sound-source frequency calculation section that calculates, in each direction and for each sound source, a per-sound-source frequency which indicates how often the sound source is detected per predetermined time, based on the own-speech detection result, the TV sound detection result, the other-speaker's speech detection result, and the sound source direction information;

a scene determination section that determines a scene using the sound source direction information and the per-sound-source frequency; and an output sound control section that controls a sound output from the hearing aid according to the determined scene, wherein the scene determination section performs scene classification for a "conversation scene" in which a wearer is engaged in conversation, a "TV viewing scene" in which a wearer is watching TV, and a "TV viewing while conversation scene" in which a wearer is simultaneously engaged in conversation and watching TV, and the output sound control section outputs TV sound received by the TV sound reception section to one ear and outputs sound for which wide directivity has been set for the other ear in a "TV viewing while conversation scene".

18. The hearing aid according to claim 17, wherein the TV sound detection section further comprises:

a TV sound reception section that receives TV sound information transmitted from the TV; and a TV-only interval detection section that detects a TV-only interval based on received TV sound and the sound signal.

19. The hearing aid according to claim 17, wherein:

the TV sound detection section further comprises:

a TV sound reception section that receives TV sound information transmitted from the TV;

a TV sound short-time power calculation section that calculates short-time power of received TV sound;

a microphone input short-time power calculation section that calculates short-time power of the sound signal; and a TV-only interval detection section that compares the TV sound short-time power and the microphone input short-time power, and detects an interval for which a difference there between is within a predetermined range as a TV-only interval.

20. The hearing aid according to claim 17, wherein the output sound control section performs directivity control.

21. The hearing aid according to claim 17, wherein the output sound control section outputs TV sound received by the TV sound reception section in a "TV viewing scene".

22. The hearing aid according to claim 17, wherein the output sound control section sets wide directivity in a "TV viewing while conversation scene".

23. A signal processing method that is a signal processing method of a hearing aid worn on both ears which has two microphone arrays respectively for both of the ears, the signal processing method comprising:

detecting a sound source direction from sound signals input from the microphone arrays;

detecting a voice of a hearing aid wearer from the sound signal;

detecting TV sound from the sound signal;

detecting speech of a speaker other than a wearer based on the detected sound source direction information, the own-speech detection result, and the TV sound detection result;

calculating, in each direction and for each sound source, a per-sound-source frequency which indicates how often the sound source is detected per predetermined time, based on the own-speech detection result, the TV sound detection result, the other-speaker's speech detection result, and the sound source direction information;

determining a scene based on the sound source direction information and the per-sound-source frequency; and controlling a sound output from the hearing aid according to the determined scene, wherein in the determining of the scene, scene classification for each scene is performed, the each scene having a "conversation scene" in which a wearer is engaged in conversation, a "TV viewing scene" in which a wearer is watching TV, and a "TV viewing while conversation scene" in which a wearer is simultaneously engaged in conversation and watching TV, and in the controlling of the sound output, the received TV sound for one ear and sound for which wide directivity has been set for the other ear are output in a "TV viewing while conversation scene".

24. A program stored on a non-transitory computer readable medium that causes a computer to execute each step of the hearing aid signal processing method according to claim 23.

25. A hearing aid worn on both ears which has two microphone arrays respectively for both of the ears, the hearing aid comprising:

a sound source direction estimation section that detects a sound source direction from sound signals input from the microphone arrays;

an own-speech detection section that detects a voice of a hearing aid wearer from the sound signal;

a TV sound detection section that detects TV sound from the sound signal;

another-speaker's speech detection section that detects speech of a speaker other than a wearer based on the detected sound source direction information, the own-speech detection result, and the TV sound detection result;

a per-sound-source frequency calculation section that calculates, in each direction and for each sound source, a per-sound-source frequency which indicates how often the sound source is detected per predetermined time, based on the own-speech detection result, the TV sound detection result, the other-speaker's speech detection result, and the sound source direction information;

a scene determination section that determines a scene using the sound source direction information and the per-sound-source frequency;

an output sound control section that controls a sound output from the hearing aid according to the determined scene; and transmission/reception section that outputs a TV sound control signal that controls TV sound, wherein the scene determination section performs scene classification for a "conversation scene" in which a wearer is engaged in conversation, a "TV viewing scene" in which a wearer is watching TV, and a "TV viewing while conversation scene" in which a wearer is simultaneously engaged in conversation and watching TV, and the output sound control section generates the TV sound control signal, based on a classification result from the scene determination section.

26. The hearing aid according to claim 25, wherein the TV sound detection section further comprises:

a TV sound reception section that receives TV sound information transmitted from the TV; and a TV-only interval detection section that detects a TV-only interval based on received TV sound and the sound signal.

27. The hearing aid according to claim 25, wherein:

the TV sound detection section further comprises:

a TV sound reception section that receives TV sound information transmitted from the TV;

a TV sound short-time power calculation section that calculates short-time power of received TV sound;

a microphone input short-time power calculation section that calculates short-time power of the sound signal; and a TV-only interval detection section that compares the TV sound short-time power and the microphone input short-time power, and detects an interval for which a difference there between is within a predetermined range as a TV-only interval.

28. The hearing aid according to claim 25, wherein the output sound control section performs directivity control.

29. The hearing aid according to claim 25, wherein the output sound control section outputs TV sound received by the TV sound reception section in a "TV viewing scene".

30. The hearing aid according to claim 25, wherein the output sound control section sets wide directivity in a "TV viewing while conversation scene".

31. A signal processing method that is a signal processing method of a hearing aid worn on both ears which has two microphone arrays respectively for both of the ears, the signal processing method comprising:

detecting a sound source direction from sound signals input from the microphone arrays;

detecting a voice of a hearing aid wearer from the sound signal;

detecting TV sound from the sound signal;

detecting speech of a speaker other than a wearer based on the detected sound source direction information, the own-speech detection result, and the TV sound detection result;

calculating, in each direction and for each sound source, a per-sound-source frequency which indicates how often the sound source is detected per predetermined time, based on the own-speech detection result, the TV sound detection result, the other-speaker's speech detection result, and the sound source direction information;

determining a scene based on the sound source direction information and the per-sound-source frequency;

controlling a sound output from the hearing aid according to the determined scene; and outputting a TV sound control signal that controls TV sound, wherein in the determining of the scene, the scene classification for each scene is performed, the each scene having a "conversation scene" in which a wearer is engaged in conversation, a "TV viewing scene" in which a wearer is watching TV, and a 'TV viewing while conversation scene" in which a wearer is simultaneously engaged in conversation and watching TV; and in the controlling of the sound output, the TV sound control signal, based on a classification result from the scene determination section, is generated.

32. A program stored on a non-transitory computer readable medium that causes a computer to execute each step of the hearing aid signal processing method according to claim 31.

* * * * *